US011154087B2

(12) United States Patent
Junker et al.

(10) Patent No.: US 11,154,087 B2
(45) Date of Patent: Oct. 26, 2021

(54) METHOD FOR PREPARING FLAVORFUL COMPOUNDS ISOLATED FROM BLACK LIQUOR AND PRODUCTS INCORPORATING THE FLAVORFUL COMPOUNDS

(71) Applicant: R.J. Reynolds Tobacco Company, Winston-Salem, NC (US)

(72) Inventors: Christopher Junker, Pfafftown, NC (US); Michael Francis Dube, Winston-Salem, NC (US); Anthony Richard Gerardi, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 360 days.

(21) Appl. No.: 15/013,751

(22) Filed: Feb. 2, 2016

(65) Prior Publication Data

US 2017/0215471 A1 Aug. 3, 2017

(51) Int. Cl.

| | |
|---|---|
| ***A24B 15/24*** | (2006.01) |
| ***A24B 15/28*** | (2006.01) |
| ***A24B 15/30*** | (2006.01) |
| ***D21C 11/00*** | (2006.01) |

(52) U.S. Cl.

CPC ..... *A24B 15/241* (2013.01); *A24B 15/24* (2013.01); *A24B 15/28* (2013.01); *A24B 15/287* (2013.01); *A24B 15/302* (2013.01); *D21C 11/0007* (2013.01)

(58) Field of Classification Search

None

See application file for complete search history.

(56) References Cited

U.S. PATENT DOCUMENTS

| | | | |
|---|---|---|---|
| 787,611 | A | 4/1905 | Daniels, Jr. |
| 1,086,306 | A | 2/1914 | Oelenheinz |
| 1,437,095 | A | 11/1922 | Delling |

(Continued)

FOREIGN PATENT DOCUMENTS

| | | |
|---|---|---|
| CN | 1324586 | 12/2001 |
| CN | 102 408 740 | 4/2012 |

(Continued)

OTHER PUBLICATIONS

Agrupis, S., et al., "Industrial utilization of tobacco stalks I—Preliminary evaluation of biomass resources," *Holzforschung*, 1999, pp 29-32, vol. 53(1).

(Continued)

*Primary Examiner* — Phu H Nguyen

(74) *Attorney, Agent, or Firm* — Womble Bond Dickinson (US) LLP

(57) ABSTRACT

A method of isolating compounds from a tobacco-derived black liquor, including receiving a black liquor from a pulping process of an input material comprising a plant of the *Nicotiana* species, treating the black liquor with an acid to lower the pH of the black liquor to about 7 or lower in order to produce a precipitate and an acidified black liquor, separating the precipitate and the acidified black liquor, extracting the acidified black liquor with an organic solvent in order to produce an organic layer extract and an aqueous layer extract, and separating the organic layer extract and the aqueous layer extract.

15 Claims, 4 Drawing Sheets

(56) References Cited

U.S. PATENT DOCUMENTS 1,757,477 A 5/1930 Rosenhoch
2,122,421 A 7/1938 Hawkinson
2,148,147 A 2/1939 Baier
2,170,107 A 8/1939 Baier
2,274,649 A 3/1942 Baier
2,516,827 A 7/1950 Marshall et al.
2,686,120 A 8/1954 Marshall et al.
2,766,148 A 10/1956 Rowland
2,770,239 A 11/1956 Prats et al.
2,795,545 A 6/1957 Gluesenkamp
3,224,927 A 12/1965 Brown et al.
3,253,978 A 5/1966 Bodendorf et al.
3,398,754 A 8/1968 Tughan
3,612,065 A 10/1971 Rosen
3,647,684 A 3/1972 Malcolm
3,661,192 A 5/1972 Nicholson et al.
3,776,897 A 12/1973 Ikari et al.
3,847,164 A 11/1974 Mattina et al.
3,861,602 A 1/1975 Smith
4,002,526 A 1/1977 Brown et al.
4,115,188 A * 9/1978 O'Brien ..... D21F 1/82 162/190
4,131,117 A 12/1978 Kite et al.
4,135,563 A 1/1979 Maucher
4,144,895 A 3/1979 Fiore
4,182,349 A 1/1980 Selke
4,194,514 A 3/1980 Campbell
4,244,381 A 1/1981 Lendvay
4,268,632 A 5/1981 Wildman et al.
4,270,552 A 6/1981 Jenkins et al.
4,289,147 A 9/1981 Wildman et al.
4,298,013 A 11/1981 Semp et al.
4,308,877 A 1/1982 Mattina
4,341,228 A 7/1982 Keritsis et al.
4,347,324 A 8/1982 Wildman et al.
4,366,824 A 1/1983 Rainer et al.
4,388,933 A 6/1983 Rainer et al.
4,421,126 A 12/1983 Gellatly
4,511,433 A 4/1985 Tournier et al.
4,589,428 A 5/1986 Keritsis
4,706,692 A 11/1987 Gellatly
4,716,911 A 1/1988 Poulose et al.
4,727,889 A 3/1988 Niven, Jr. et al.
4,793,898 A 12/1988 Laamanen et al.
4,887,618 A 12/1989 Bernasek et al.
4,895,175 A 1/1990 Baskevitch et al.
4,941,484 A 7/1990 Clapp et al.
4,962,774 A 10/1990 Thomasson et al.
4,967,771 A 11/1990 Fagg et al.
4,987,906 A 1/1991 Young et al.
5,005,593 A 4/1991 Fagg
5,005,620 A 4/1991 Morey
5,018,540 A 5/1991 Grubbs et al.
5,049,236 A 9/1991 Dimmel et al.
5,056,537 A 10/1991 Brown et al.
5,060,669 A 10/1991 White et al.
5,065,775 A 11/1991 Fagg
5,074,319 A 12/1991 White et al.
5,091,054 A 2/1992 Meier et al.
5,099,862 A 3/1992 White et al.
5,121,757 A 6/1992 White et al.
5,131,415 A 7/1992 Munoz et al.
5,143,097 A 9/1992 Stephen Sohn et al.
5,148,819 A 9/1992 Fagg
5,159,942 A 11/1992 Brinkley et al.
5,197,494 A 3/1993 Kramer
5,230,354 A 7/1993 Smith et al.
5,234,008 A 8/1993 Fagg
5,243,999 A 9/1993 Smith
5,246,543 A 9/1993 Meier et al.
5,296,621 A 3/1994 Roos et al.
5,301,694 A 4/1994 Raymond et al.
5,318,050 A 6/1994 Gonzalez-Parra et al.
5,325,877 A 7/1994 Young et al.
5,343,879 A 9/1994 Teague
5,360,022 A 11/1994 Newton et al.
5,435,325 A 7/1995 Clapp et al.
5,445,169 A 8/1995 Brinkley et al.
5,501,237 A 3/1996 Young et al.
5,533,530 A 7/1996 Young et al.
5,547,542 A 8/1996 Landfors
5,582,681 A 12/1996 Back et al.
5,715,844 A 2/1998 Young et al.
5,724,998 A 3/1998 Gellatly et al.
5,788,812 A 8/1998 Agar et al.
5,981,837 A 11/1999 Chapple
6,007,678 A 12/1999 Linsten et al.
6,019,870 A 2/2000 Devic et al.
6,083,729 A 7/2000 Martin et al.
6,100,385 A 8/2000 Naae et al.
6,131,584 A 10/2000 Lauterbach
6,165,318 A 12/2000 Paren et al.
6,214,164 B1 4/2001 Rantala
6,216,706 B1 4/2001 Kumar et al.
6,262,284 B1 7/2001 Khachik
6,398,908 B1 6/2002 Hermansson et al.
6,489,538 B1 12/2002 Chapple
6,503,369 B2 1/2003 Rousu et al.
6,504,085 B1 1/2003 Howard
6,610,908 B1 8/2003 Chapple
6,772,767 B2 8/2004 Mua et al.
6,773,552 B1 8/2004 Albert et al.
6,824,645 B2 11/2004 Jaschinski et al.
6,895,974 B2 5/2005 Peele
6,923,887 B2 8/2005 Pan
7,179,930 B2 2/2007 Bhaskaran et al.
7,198,808 B2 4/2007 Krasutsky et al.
7,337,782 B2 3/2008 Thompson
7,910,209 B2 3/2011 Uchida et al.
7,943,350 B2 5/2011 Vlasenko et al.
7,959,765 B2 6/2011 Argyropoulos
8,360,072 B2 1/2013 Krauss
8,784,566 B2 7/2014 Zhang
8,808,781 B2 8/2014 Stecker et al.
8,893,725 B2 11/2014 Dube et al.
2002/0197688 A1 12/2002 Pandolfino
2004/0231060 A1 11/2004 Burdette et al.
2006/0003036 A1 1/2006 Shaath et al.
2006/0130859 A1 6/2006 Mua et al.
2008/0196847 A1 8/2008 Pieter van Heiningen et al.
2009/0056209 A1 3/2009 Baciu et al.
2009/0090478 A1 4/2009 Hollomon et al.
2009/0118477 A1 5/2009 Hallberg et al.
2009/0145021 A1 6/2009 Guay et al.
2009/0246525 A1 10/2009 Uchida et al.
2010/0017916 A1 1/2010 Pappan et al.
2010/0036113 A1 2/2010 Mambrim Filho et al.
2010/0116281 A1 5/2010 Marshall et al.
2010/0180903 A1 7/2010 Cooper et al.
2010/0249390 A1 9/2010 Azuma et al.
2010/0279361 A1 11/2010 South et al.
2011/0083683 A1 4/2011 Krauss
2011/0174323 A1 7/2011 Coleman, III et al.
2012/0040408 A1 2/2012 Decker et al.
2012/0141648 A1 6/2012 Morton et al.
2012/0152265 A1 6/2012 Dube et al.
2012/0192880 A1 8/2012 Dube et al.
2012/0211016 A1 8/2012 Byrd, Jr. et al.
2012/0272976 A1 11/2012 Byrd et al.
2013/0014771 A1 1/2013 Coleman, III et al.
2013/0253100 A1 9/2013 Bailey et al.
2013/0276801 A1 10/2013 Byrd, Jr. et al.
2014/0227161 A1 8/2014 Manesh et al.
2014/0256829 A1 9/2014 Junker
2014/0271951 A1 9/2014 Mua et al.
2014/0271952 A1 9/2014 Mua et al.
2014/0326422 A1 11/2014 Fallon et al.
2015/0034109 A1 2/2015 Dube et al.
2015/0107790 A1 4/2015 Sixta et al.
2015/0201669 A1 7/2015 Junker et al.

(56) References Cited

U.S. PATENT DOCUMENTS

2015/0292152 A1* 10/2015 Hata ..... A24B 15/18
131/290
2016/0208440 A1 7/2016 Byrd, Jr. et al.

FOREIGN PATENT DOCUMENTS

| | | |
|---|---|---|
| CN | 102 475 353 | 5/2012 |
| DE | 10 2010 048 614 | 4/2012 |
| JP | 1162008 | 10/1997 |
| KR | 10-2006-0054728 | 5/2006 |
| KR | 1020120022238 | 3/2012 |
| WO | WO 2012/010401 | 1/2012 |

OTHER PUBLICATIONS

Alonso et al., "Integrated Conversion of Henncellulose and Cellulose from Lignocellulosic Biomass," *Energy & Environmental Science*, 2013, vol. 6, pp. 76-80.
Bose, et al., Lignin Content Versus Syringyl to Guaiacyl Ration Amongst Poplars. Bioresour. Technol. 2009, 100, 1628-1633.
Chen, et al., "Alkali-oxygen pulping of rice straw—Two-stage pulping by alkali soaking and oxygen cooking," *Tappi Journal*, 1994, pp. 109-113, vol. 77(7).
Crabbe et al., "Biodiesel Production of Crude Palm Oil and Evaluation of Butanol Extraction and Fuel Properties," *Process Biochemistry*, 37, 65-71, (2001).
Gao, et al., "Effects of beating on tobacco stalk mechanical pulp," *Cellulose chemistry and technology*, 2012, pp. 277-282, vol. 46(3-4).
Kajita, et al., "Improvement in pulping and bleaching properties of xylem from transgenic tobacco plants," *Journal of the Science of Food and Agriculture*, 2002, pp. 1216-1223, vol. 82(10).
Kimura, et al., "Studies on the manufacture of tobacco stem pulp II—Pulping of tobacco stem with alkalies (Japanese language)," *Japan Tappi Journal*, 1962, pp. 978-984, vol. 16(12).
Kodama et al., "Isolation of a New Terpene Glucoside, 3-Hydroxy-5, 6-epoxy-β-ionyl-β-D-glucopyranoside from Flue-cured Tobacco", *Agric. Biol. Chem.*, 1981, pp. 941-944, vol. 45, No. 4.
Li et al., "Thermoplastics With Very High Lignin Content," *Lignin: Historical, Biological and Materials Perspectives*, 2000, pp. 351-366, vol. 742.
Li et al. Nanfang Nongye Xuebao. 2012. vol. 43, No. 8, pp. 1158-1163. CAPLUS Abstract enclosed.
Liu et al. J. Henan Agricult. Sci. 2012. vol. 41, No. 9, pp. 50-52. CAPLUS Abstract enclosed.
Mohta et al., "Production of Refiner Mechanical Pulp from Kenaf for Newsprint in Developing Countries," *TAPPI Journal*, 2001, vol. 3(4).
Ralph et al., "NMR Characterization of Altered Lignins Extracted from Tobacco Plants Down-regulated for Lignification Enzymes Cinnamylalcohol Dehydrogenase and Cinnamoyl-CoA Reductase," *Proceedings of the National Academy of Sciences*, 1998, pp. 12803-12808, vol. 95.
Sabharwal et al., Refiner Mechanical and Biomechanical Pulping of Jute, *Holzforschung*, 49: 537-544, 1995.
Stenesh, Biochemistry, Chapter 6. Lipids and Membranes, *Springer Science+Business Media*, 1998, pp. 141-144.
Tso (1972), Physiology and Biochemistry of Tobacco Plants (Stroudsburg: Dowden, Hutchinson and Ross), p. 205.
Vickery et al. The Non-Volatile Organic Acids of Green Tobacco Leaves; 1931; *Journal of Biological Chemistry*; vol. 90; pp. 637-653
Wu et al. "Improved Alkaline Oxidation Process for the Production of Aldehydes (Vanillin and Syringaldehyde) from Steam-Explosion Hardwood Lignin," *Ind. Eng. Chem. Res.*, 1994, vol. 33, pp. 718-723.
Wu et al. Yunnan Nongye Daxue Xuebao. 2013. vol. 28, No. 3, pp. 353-359. CAPLUS Abstract enclosed.
Xi et al. Yancao Keji. 2011. vol. 5, pp. 29-33. CAPLUS Abstract enclosed.
Zhang, Yi-Heng Percival et al., Toward an Aggregated Understanding of Enzymatic Hydrolysis of Cellulose: Noncomplexed Cellulase Systems. Wiley InterScience. Biotechnology and Bioengineering, vol. 88, No. 7, Dec. 30, 2004, p. 797-824.
Ziaie-Shirkolaee et al. "Study on Cellulose Degradation During Organosolv Delignification of Wheat Straw and Evaluation of Pulp Properties," *Iranian Polymer Journal*, 2007, pp. 83-96, vol. 16, (2).
Agrupis, S., et al., "Industrial utilization of tobacco stalks II: preparation and characterization of tabacco pulp by steam explosion pulping," *Journal of Wood Science*, 2000, vol. 46, pp. 222-229.

* cited by examiner

METHOD FOR PREPARING FLAVORFUL COMPOUNDS ISOLATED FROM BLACK LIQUOR AND PRODUCTS INCORPORATING THE FLAVORFUL COMPOUNDS

FIELD OF THE INVENTION

The present invention relates to products made or derived from tobacco, or that otherwise incorporate tobacco or components of tobacco. Of particular interest are ingredients or components obtained or derived from a plant of the *Nicotiana* species.

BACKGROUND OF THE INVENTION

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user. More recently, popular so-called "electronic cigarettes" employ electrically generated heat to provide vapors incorporating tobacco components for inhalation. See, for example, those types of tobacco products and uses of processed tobaccos described in the background art set forth in U.S. Pat. Nos. 7,503,330 to Borschke et al.; 7,726,320 to Robinson et al. and 9,204,667 to Cantrell et al.; and U.S. Pat. Pub. No. 2015/0223522 to Ampolini et al., which are incorporated herein by reference. Tobacco-containing products incorporate various types of tobaccos in various forms (e.g., as blended cut filler, as formed or shredded reconstituted tobacco, as shredded strips or as tobacco extracts).

A black liquor generally refers to a liquid product obtained from a digesting treatment used in a pulp production process. Such a product is a highly basic (e.g., pH>14) aqueous extract that contains high levels of inorganic compounds used in the pulping process including sodium hydroxide and sodium sulfite, as well as lignin residues and hemicellulose from the biomass and many breakdown products of both the hemicellulose and lignin. It has a very characteristic strong odor of sulfur and alkali, and contains high levels of dissolved organic and inorganic solids. As a result, it has been used in flavoring applications. See, e.g., U.S. Pat. Pub. No. 2015/0292152 to Hata et al., which is herein incorporated by reference.

It would be desirable to provide processed tobaccos or tobacco-derived materials that would have applications as components of tobacco products. In particular, it would be advantageous to develop methods of isolating flavorful compounds for use in tobacco products from a black liquor produced by a pulping process, specifically, by pulping a plant of the *Nicotiana* species.

SUMMARY OF THE INVENTION

The present invention provides methods for isolating compounds from a tobacco-derived black liquor, comprising receiving a black liquor from a pulping process of an input material comprising a plant of the *Nicotiana* species, treating the black liquor with an acid to lower the pH of the black liquor to about 7 or lower in order to produce a precipitate and an acidified black liquor, separating the precipitate and the acidified black liquor, extracting the acidified black liquor with an organic solvent in order to produce an organic layer extract and an aqueous layer extract, and separating the organic layer extract and the aqueous layer extract. In various embodiments, the organic solvent can have a polarity of about 2.0 or greater. The organic solvent can comprise methyl-t-butyl-ether, ethyl acetate, or a combination thereof, for example. In various embodiments, the treating step can comprise lowering the pH of the black liquor is lowered to about 4 or less. The acid used in the treating step can be hydrochloric acid, sulfuric acid, or a combination thereof, for example.

In various embodiments, the method can further comprise neutralizing the acidified black liquor to a pH of about 7 prior to the step of extracting the acidified black liquor. In some embodiments, the method can further comprise treating the organic layer extract with a drying agent in order to remove excess water. In certain embodiments, the organic layer extract can be incorporated into a tobacco product. The tobacco product can be a smoking article, for example. In certain embodiments, the tobacco product can be a smokeless tobacco product.

In some embodiments, the methods of the present invention can further comprise concentrating the organic layer extract by evaporating the organic solvent in order to produce a concentrated organic layer extract. The method can further comprise treating the concentrated organic layer extract with a drying agent in order to remove excess organic solvent.

In various embodiments, the concentrated organic layer can be separated into multiple fractions, wherein each fraction comprises at least one flavor compound. In certain embodiments, the at least one flavor compound can be selected from the group consisting of acetic acid, 3,5-dimethylcyclopentenolone, corylone, guaiacol, 4-vinyl-2-methylphenol, vanillin, 2,6-dimethoxyphenol, acetovanillone, syringaldehyde, acetosyringone, and combinations thereof. The step of separating the concentrated organic layer extract into multiple fractions can comprise chromatography separation of the concentrated organic layer extract, for example. In some embodiments, the step of separating the concentrated organic layer extract into multiple fractions comprises distillation of the concentrated organic layer extract. In various embodiments of the present invention, the methods described herein can further comprise incorporating at least one fraction into a tobacco product. The tobacco product can be a smoking article, for example. In certain embodiments, the tobacco product can be a smokeless tobacco product.

In some embodiments, the method can further comprise receiving a tobacco material comprising at least one of a stalk material and a root material of a harvested plant of the *Nicotiana* species, chemically pulping the tobacco material to form a tobacco-derived pulp and the black liquor, and separating the tobacco-derived pulp and the black liquor. The tobacco material can comprise at least about 90 percent by dry weight of at least one of the stalk material and the root material of the harvested plant of the *Nicotiana* species, for example.

A tobacco product comprising a flavorant compound, the flavorant compound being in the form of an organic extract of a tobacco-derived black liquor is also provided herein. In various embodiments, the flavor compound can be selected from the group consisting of acetic acid, 3,5-dimethylcyclopentenolone, corylone, guaiacol, 4-vinyl-2-methylphenol, vanillin, 2,6-dimethoxyphenol, acetovanillone, syringaldehyde, acetosyringone, and combinations thereof. In some embodiments, the tobacco product can be a smoking article. In certain embodiments, the tobacco product can be a smokeless tobacco product.

BRIEF DESCRIPTION OF THE DRAWINGS

In order to provide an understanding of embodiments of the invention, reference is made to the appended drawings, which are not necessarily drawn to scale, and in which reference numerals refer to components of exemplary embodiments of the invention. The drawings are exemplary only, and should not be construed as limiting the invention.

DETAILED DESCRIPTION

Figure 1:
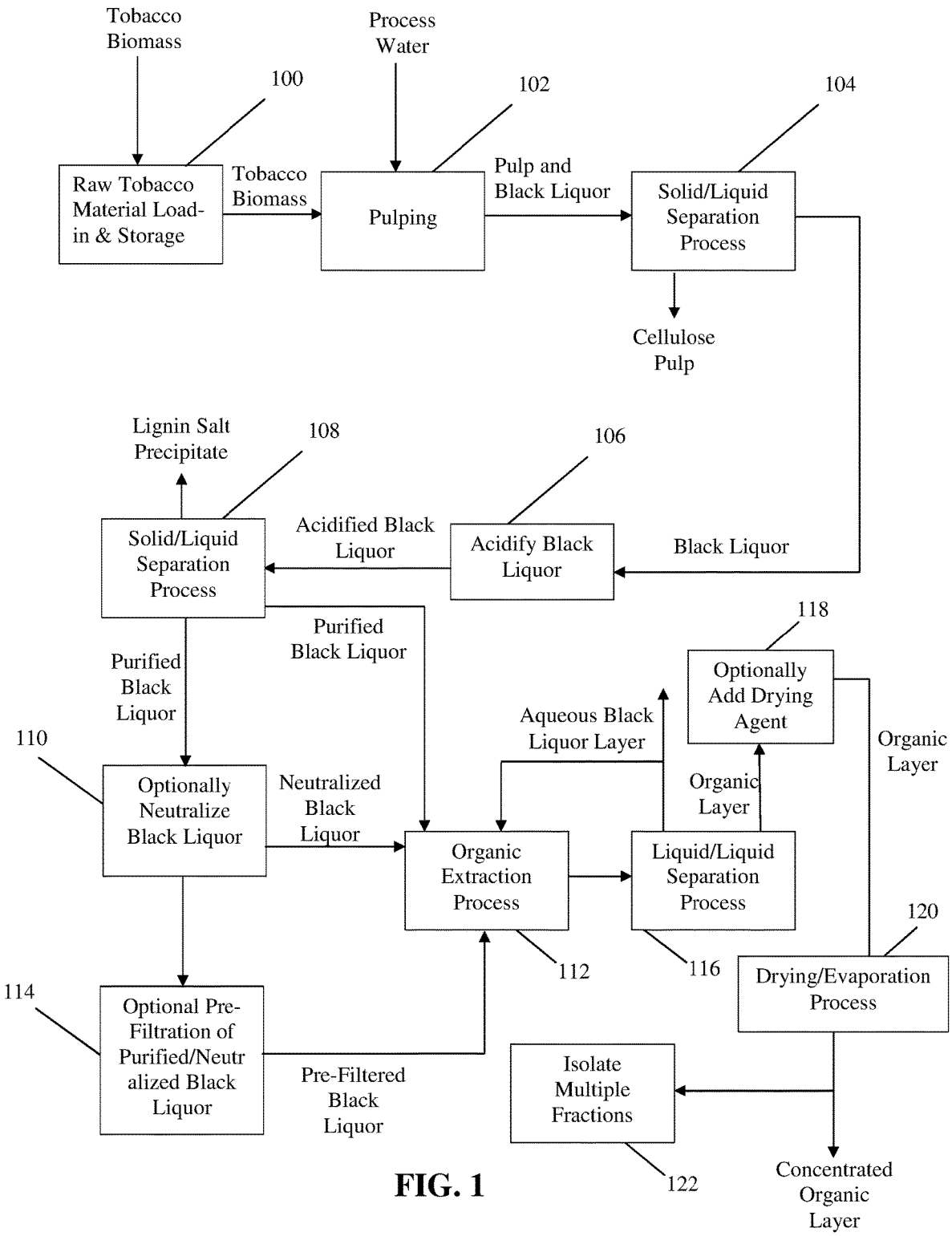
FIG. 1 is a block diagram of a method for producing flavorful compounds isolated from black liquor derived from a plant of the *Nicotiana* species according to an example embodiment.

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The present invention provides methods of forming black liquor derived from a harvested plant of the *Nicotiana* species, and related products. As used herein, the term "tobacco-derived black liquor" is understood to refer to a liquid byproduct from a tobacco pulping process. In various embodiments, the cellulosic material subjected to the tobacco pulping process predominantly includes biomass derived from a plant of the *Nicotiana* species.

As described in more detail below, biomass derived from a plant of the *Nicotiana* species can be subjected to a pulping process which results in a cellulose pulp and a residual black liquor. The resulting black liquor can be separated from the solid material and then subjected to a liquid-liquid extraction to produce a tobacco-derived, organic black liquor extract. Flavorful compounds can be isolated from the black liquor extract, as discussed in more detail below.

Tobacco Materials

The present disclosure is applicable, in some embodiments, for large scale production, where the term large scale production refers to processing large quantities of a biomass (e.g., tobacco) on a mass production level. The term "biomass" and related terms such as "biomatter" and "plant source" are understood to refer to any portion of a harvested plant that may be processed to extract, separate, or isolate components of interest therefrom. The processing may be carried out in relation to various plants or portions thereof, such as seeds, flowers, stalks, stems, roots, tubers, leaves, or any further portions of the plant.

The selection of the plant from the *Nicotiana* species utilized in the methods of the invention can vary; and in particular, the types of tobacco or tobaccos can vary. The type of tobacco used as the source of input material for each component described herein can vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and *Rustica* tobaccos, as well as various other rare or specialty tobaccos. Descriptions of various types of tobaccos, growing practices and harvesting practices are set forth in *Tobacco Production, Chemistry and Technology,* Davis et al. (Eds.) (1999), which is incorporated herein by reference. Various representative types of plants from the *Nicotiana* species are set forth in Goodspeed, *The Genus Nicotiana*, (Chonica Botanica) (1954); U.S. Pat. Nos. 4,660,577 to Sensabaugh, Jr. et al.; 5,387,416 to White et al. and 7,025,066 to Lawson et al.; US Patent Appl. Pub. Nos. 2006/0037623 to Lawrence, Jr. and 2008/0245377 to Marshall et al.; each of which is incorporated herein by reference.

The particular *Nicotiana* species of material used in the invention could also vary. Of particular interest are *N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, and N. x sanderae. Also of interest are N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. rustica, N. simulans, N. stocktonii, N. suaveolens, N. tabacum, N. umbratica, N. velutina, and N. wigandioides.* Other plants from the *Nicotiana* species include *N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis subsp. Hersperis, N. pauciflora, N. petunioides, N. quadrivalvis, N. repanda, N. rotundifolia, N. solanifolia* and *N. spegazzinii.* The *Nicotiana* species can be derived using genetic-modification or crossbreeding techniques (e.g., tobacco plants can be genetically engineered or crossbred to increase or decrease production of certain components or to otherwise change certain characteristics or attributes). See, for example, the types of genetic modifications of plants set forth in U.S. Pat. Nos. 5,539,093 to Fitzmaurice et al.; 5,668,295 to Wahab et al.; 5,705,624 to Fitzmaurice et al.; 5,844,119 to Weigl; 6,730,832 to Dominguez et al.; 7,173,170 to Liu et al.; 7,208,659 to Colliver et al.; and 7,230,160 to Benning et al.; US Patent Appl. Pub. No. 2006/0236434 to Conkling et al.; and PCT WO 2008/103935 to Nielsen et al.

The portion or portions of the plant of the *Nicotiana* species used according to the present invention can vary. For example, virtually all of the plant (e.g., the whole plant) can be harvested, and employed as such. Alternatively, various parts or pieces of the plant can be harvested or separated for further use after harvest. For example, the leaves, stem, stalk, roots, lamina, flowers, seed, and various portions and combinations thereof, can be isolated for further use or treatment. The plant material of the invention may thus comprise an entire plant or any portion of a plant of the *Nicotiana* species. See, for example, the portions of tobacco plants set forth in US Pat. Appl. Pub. Nos. 2011/0174323 to Coleman, III et al. and 2012/0192880 to Dube et al., which are incorporated by reference herein.

The plant component or components from the *Nicotiana* species can be employed in an immature form. That is, the plant can be harvested before the plant reaches a stage normally regarded as ripe or mature. As such, for example, the plant can be harvested when the tobacco plant is at the point of a sprout, is commencing leaf formation, is commencing flowering, or the like.

The plant components from the *Nicotiana* species can be employed in a mature form. That is, the plant can be harvested when that plant reaches a point that is traditionally viewed as being ripe, over-ripe or mature. As such, for example, through the use of tobacco harvesting techniques conventionally employed by farmers, Oriental tobacco plants can be harvested, burley tobacco plants can be harvested, or Virginia tobacco leaves can be harvested or primed by stalk position.

After harvest, the plant of the *Nicotiana* species, or portion thereof, can be used in a green form (e.g., tobacco can be used without being subjected to any curing process). In various embodiments, the tobacco material can be subjected to various treatment processes such as, refrigeration, freezing, drying (e.g., freeze-drying or spray-drying), irradiation, yellowing, heating, cooking (e.g., roasting, frying or boiling), fermentation, bleaching or otherwise subjected to storage or treatment for later use. In some embodiments, harvested tobacco can be sprayed with a buffer or antioxidant (e.g., a sodium metabisulfite buffer) to prevent the green plants from browning prior to further treatment as described herein. Other exemplary processing techniques are described, for example, in US Pat. Appl. Pub. Nos. 2009/0025739 to Brinkley et al. and 2011/0174323 to Coleman, III et al., which are incorporated by reference herein. At least a portion of the plant of the *Nicotiana* species can be treated with enzymes and/or probiotics before or after harvest, as discussed in US Pat. Appl. Pub. Nos. 2013/0269719 to Marshall et al., and 2014/0020694 to Moldoveanu, which are incorporated herein by reference.

A harvested portion or portions of the plant of the *Nicotiana* species can be physically processed. A portion or portions of the plant can be separated into individual parts or pieces (e.g., roots can be removed from stalks, stems can be removed from stalks, leaves can be removed from stalks and/or stems, petals can be removed from the remaining portion of the flower). Although any single part of the tobacco plant or multiple parts of the tobacco plant can be used according to the present invention, preferably tobacco root, tobacco stalk, tobacco leaves, or a combination thereof are used. The harvested portion or portions of the plant can be further subdivided into parts or pieces (e.g., shredded, cut, comminuted, pulverized, milled or ground into pieces or parts that can be characterized as filler-type pieces, granules, particulates or fine powders). The harvested portion or portions of the plant can be subjected to external forces or pressure (e.g., by being pressed or subjected to roll treatment). For example, in certain embodiments, tobacco stalk, either alone or in combination with other portions of the plant (e.g., stalk and leaf together) can be used and may, in some embodiments, be subjected to the types of treatment described in US Pat. Appl. Publ. No. 2012/0152265 to Dube et al., which is incorporated herein by reference.

In certain embodiments, the tobacco material can be treated with water to extract an aqueous soluble component of the tobacco material therefrom. In some preferred embodiments, the particulate or powder tobacco material can be combined with water to form a moist aqueous material (e.g., in the form of a suspension or slurry) and the resulting material is typically heated to effectuate extraction of various compounds. The water used to form the moist material can be pure water (e.g., tap water or deionized water) or a mixture of water with suitable co-solvents such as certain alcohols. In certain embodiments, the amount of water added to form the moist material can be at least about 50 weight percent, or at least about 60 weight percent, or at least about 70 weight percent, based on the total weight of the moist material. In some cases, the amount of water can be described as at least about 80 weight percent or at least about 90 weight percent.

The extract thus produced may comprise some level of solid (insoluble) material entrained in the liquid. Accordingly, in this context, "extract" is intended to mean the material obtained upon contacting the tobacco material with water and may comprise both soluble components dissolved therein and solid dispersed components. Following the extraction process, the extracted liquid component is typically filtered to remove at least some of the solids. In other words, some or all of the portion of the tobacco material insoluble in the aqueous solvent is removed. The process of filtration can comprise passing the liquid through one or more filter screens to remove selected sizes of particulate matter. Screens may be, for example, stationary, vibrating, rotary, or any combination thereof. Filters may be, for example, press filters or pressure filters. In some embodiments, the filtration method used can involve microfiltration, ultrafiltration, and/or nanofiltration. A filter aid can be employed to provide effective filtration and can comprise any material typically used for this purpose. For example, some common filter aids include cellulose fibers, perlite, bentonite, diatomaceous earth, and other silaceous materials. To remove solid components, alternative methods can also be used, for example, centrifugation or settling/sedimentation of the components and siphoning off of the liquid. See, for example, the processes and products described in U.S. Pat. App. Pub. Nos. 2012/0152265 to Dube et al. and 2012/0192880 to Dube et al., herein incorporated by reference in their entireties. The extracted solid components can be used as the starting tobacco material in various embodiments of the invention described herein.

Further, in some embodiments the tobacco input can comprise reconstituted tobacco. Typically, tobacco stems are used in making such a reconstituted tobacco sheet, because the fibrous nature of those stems provides strength and structural integrity to the resulting sheet. See, for example, U.S. Pat. Nos. 3,398,754 to Tughan; 3,847,164 to Mattina; 4,131,117 to Kite; 4,182,349 to Selke; 4,270,552 to Jenkins; 4,308,877 to Mattina; 4,341,228 to Keritsis; 4,421,126 to Gellatly; 4,706,692 to Gellatly; 4,962,774 to Thomasson; 4,941,484 to Clapp; 4,987,906 to Young; 5,056,537 to Brown; 5,143,097 to Sohn; 5,159,942 to Brinkley et al.; 5,325,877 to Young; 5,445,169 to Brinkley; 5,501,237 to Young; and 5,533,530 to Young, which are incorporated herein by reference.

Cellulosic Pulp and Residual Black Liquor Derived From Tobacco Materials

According to the present invention, black liquor can be derived from a tobacco pulping process. As illustrated at operation 100 of FIG. 1, for example, preparation of a tobacco-derived black liquor according to the present invention can comprise providing a biomass derived from a plant of the *Nicotiana* species. Providing the tobacco biomass can include harvesting a plant from the *Nicotiana* species and, in certain embodiments, separating certain components from the plant such as the stalks and/or roots, and physically processing these components. Although whole tobacco plants or any component thereof (e.g., leaves, flowers, stems, roots, stalks, and the like) could be used in the invention, it can be advantageous to use stalks and/or roots of the tobacco plant. For example, in certain embodiments, the tobacco material input comprises at least about 90%, at least about 92%, at least about 95%, or at least about 97% by dry weight of at least one of the stalk material and the root material of a harvested plant of the *Nicotiana* species. The remainder of the description related to cellulosic pulp and black liquor derived from tobacco material focuses on use of stalks and/or roots from the plant, but the invention is not limited to such embodiments.

The tobacco stalks and/or roots can be separated into individual pieces (e.g., roots separated from stalks, and/or root parts separated from each other, such as big root, mid root, and small root parts) or the stalks and roots may be combined. By "stalk" is meant the stalk that is left after the leaf (including stem and lamina) has been removed. "Root" and various specific root parts useful according to the present invention may be defined and classified as described, for example, in Mauseth, Botany: An Introduction to Plant Biology: Fourth Edition, Jones and Bartlett Publishers (2009) and Glimn-Lacy et al., Botany Illustrated, Second Edition, Springer (2006), which are incorporated herein by reference. The harvested stalks and/or roots are typically cleaned, ground, and dried to produce a material that can be described as particulate (i.e., shredded, pulverized, ground, granulated, or powdered). As used herein, stalks and/or roots can also refer to stalks and/or roots that have undergone an extraction process to remove water soluble materials. The cellulosic material (i.e., pulp) remaining after stalks and/or root materials undergo an extraction process can also be useful in the present invention.

The roots and stalks of a tobacco plant have a higher weight percentage of cellulosic content than tobacco stems. As a result, the roots and stalks of a tobacco plant have a higher cellulosic pulp yield potential than tobacco stems. Additionally, tobacco stems represent a valuable starting material for the preparation of tobacco reconstituted sheet and expanded stem materials used in tobacco products. Use of tobacco stems as a source for cellulosic pulp and black liquor would decrease the supply of tobacco stems that can be used in other tobacco manufacturing processes. Tobacco stalks and roots represent a tobacco material not otherwise used in tobacco manufacturing and as such, represent an excellent raw material for the preparation of tobacco-derived black liquor. An additional tobacco raw material that is otherwise not used in tobacco manufacturing is so-called tobacco dust (i.e., a very small particle tobacco material collected during cigarette manufacturing) and so-called stemmery dust (i.e., a tobacco-derived material collected during the stemming of the tobacco leaves). Tobacco dust and stemmery dust can also be used to produce a cellulosic sugar.

Preferably, the physical processing step comprises comminuting, grinding, and/or pulverizing stalks and/or roots from a *Nicotiana* plant into particulate form using equipment and techniques for grinding, milling, or the like. In certain preferred embodiments, the stalks and/or roots are dried prior to the physical processing step, and thus are relatively dry in form during grinding or milling. For example, the stalks and/or roots can be ground or milled when the moisture content thereof is less than about 15 weight percent or less than about 5 weight percent. In such embodiments, equipment such as hammer mills, cutter heads, air control mills, or the like may be used.

The tobacco material provided following the comminuting, grinding, and/or pulverizing of *Nicotiana* stalks and/or roots can have any size. The tobacco material can be such that parts or pieces thereof have an average width and/or length between about 1/16 inch to about 2 inches, about 1/4 inch to about 1 inch, or about 1/4 inch to about 1/2 inch. In some embodiments, the average width and/or length of the tobacco material is greater than or equal to about 1/8 inches, greater than or equal to about 1/4 inch, greater than or equal to about 1/2 inch, greater than or equal to about 1 inch, or greater than or equal to about 2 inches.

The exact composition of the tobacco material used to produce black liquor can vary. The composition may depend, in part, on whether the tobacco material is prepared from *Nicotiana* stalks, roots, or a combination thereof. Tobacco material prepared solely from material obtained from *Nicotiana* stalks may exhibit different characteristics than tobacco material prepared solely from material obtained from *Nicotiana* roots. Similarly, tobacco material prepared from material obtained from certain parts of one of these components may exhibit different characteristics than material obtained from other parts of this component (e.g., tobacco material prepared from mid-root material may be different from tobacco material prepared from big root material). For example, in certain embodiments, tobacco material derived from *Nicotiana* stalk has a higher content of volatile compounds than tobacco material derived from *Nicotiana* root.

In various embodiments of the present invention, the tobacco material can be converted into a cellulose material and a residual black liquor through a delignification of the tobacco material, for example. Delignification of tobacco materials can involve a number of operations. See, e.g., U.S. patent application Ser. Nos. 14/599,258 to Byrd Jr. et al., filed Jan. 16, 2015, which is herein incorporated by reference in its entirety. As an initial step, tobacco biomass can undergo a pulping process. Pulps can be produced from raw materials either mechanically or chemically, as illustrated at operation 102 in FIG. 1, for example.

In a mechanical pulping process, raw tobacco materials can be chipped, and then fed between refiners where the chips are made into fibers between revolving metal disks, for example. Mechanical pulping does not separate the lignin from cellulose fibers, so the yield is often relatively high (i.e., above 95%).

In some embodiments, a chemical pulping process can be used in the methods described herein. A chemical pulping process separates lignin from cellulose fibers by dissolving lignin in a cooking liquor such that the lignin, which binds the cellulose fibers together, can be washed away from the cellulose fibers without seriously degrading the cellulose fibers. There are three main chemical pulping processes known in the art. Soda pulping involves cooking raw material chips in a sodium hydroxide cooking liquor. The Kraft process evolved from soda pulping and involves cooking raw material chips in a solution of sodium hydroxide and sodium sulfide. The acidic sulfite process involves using sulfurous acid and bisulfate ion in the cook. Any chemical pulping process known in the art, including, but not limited to the three examples listed above, can be used to produce a tobacco pulp and residual black liquor from raw tobacco materials.

A cooking liquor can comprise a strong base. As used herein, a strong base refers to a basic chemical compound (or combination of such compounds) that is able to deprotonate very weak acids in an acid-base reaction. For example, strong bases that can be useful in the present invention include, but are not limited to one or more of sodium hydroxide, potassium hydroxide, sodium carbonate, sodium bicarbonate, potassium carbonate, potassium bicarbonate, ammonium hydroxide, ammonium bicarbonate, and ammonium carbonate. In some embodiments, the weight of the strong base can be greater than about 5%, greater than about 25%, or greater than about 40% of the weight of the tobacco input. In certain embodiments, the weight of the strong base can be less than about 60% or less than about 50% of the weight of the tobacco input. In still further embodiments, the weight of the strong base can be from about 5% to about 50%, or from about 30% to about 40% of the weight of the tobacco input. Various other chemicals and weight ratios thereof can also be employed to chemically pulp the tobacco input in other embodiments.

In addition to combining a tobacco input with a strong base, chemically pulping a tobacco input can include heating the tobacco input and the strong base. Heating the tobacco input and the strong base can be conducted to increase the efficacy of the chemical pulping. In this regard, an increase in either cooking temperature or time will result in an increased reaction rate (rate of lignin removal).

For example, a method of producing tobacco-derived black liquor can comprise soda pulping a tobacco input to form a tobacco pulp and black liquor. Raw tobacco materials can be cooked with a 20-40% NaOH solution. The ratio of cooking liquor to stems can be, for example, from about 6:1 to about 8:1. This mixture can be heated to a maximum temperature of about 150° C. to about 175° C. in approximately 60-90 minutes and cooked at the maximum temperature for about 40 minutes to about 180 minutes, for example.

In some embodiments, a method of producing tobacco-derived black liquor can comprise Kraft pulping a tobacco input to form a tobacco pulp and black liquor. Raw tobacco materials can be cooked with a liquor comprising about 15-25% $Na_2O$ and about 20-30% sulfidity. The ratio of cooking liquor to stems can be, for example, from about 8:1 to about 10:1. This mixture can be heated to a maximum temperature of about 160° C. to about 180° C. at approximately 60-150 minutes and cooked at the maximum temperature for about 110 to about 150 minutes, for example. The resulting pulps can have about a 42-45% yield, for example.

In some embodiments, the tobacco-derived pulp can optionally undergo a de-lignification process (e.g., an acid or a base can be used to hydrolyze the tobacco-derived pulp and separate the lignin). In addition, the pulp can be rinsed with water and dewatered at least once. The pulp can be dewatered by wet classification, centrifugation, filtration, or similar liquid separation processes. A centrifuge or other similar equipment can help with pulp and black liquor syrup (i.e., solids and liquid) separations. See, e.g., the equipment disclosed in U.S. Pat. Nos. 521,104 to Davis, 3,168,474 to Stallman et al., 5,713,826 to West, and 7,060,017 to Collier, each of which is herein incorporated by reference in its entirety. For example, a basket centrifuge can be useful to help with the pulp dewatering and black liquor recovery activities.

In some embodiments, the pulping process can further include bleaching the tobacco-derived pulp. The bleaching operation can be conducted to remove the residual non-cellulosic materials left over after pulping without damaging the cellulose. Exemplary processes for treating tobacco with bleaching agents are discussed, for example, in U.S. Pat. Nos. 787,611 to Daniels, Jr.; 1,086,306 to Oelenheinz; 1,437,095 to Delling; 1,757,477 to Rosenhoch; 2,122,421 to Hawkinson; 2,148,147 to Baier; 2,170,107 to Baier; 2,274,649 to Baier; 2,770,239 to Prats et al.; 3,612,065 to Rosen; 3,851,653 to Rosen; 3,889,689 to Rosen; 4,143,666 to Rainer; 4,194,514 to Campbell; 4,366,824 to Rainer et al.; 4,388,933 to Rainer et al.; and 4,641,667 to Schmekel et al.; and PCT WO 96/31255 to Giolvas, all of which are incorporated by reference herein.

In some embodiments, the method of producing a tobacco-derived cellulose material and black liquor can include one or more additional operations. See, e.g., U.S. Patent Appl. Pub. No. 2013/0276801 to Byrd Jr. et al., herein incorporated by reference in its entirety. For example, the tobacco input can undergo further processing steps prior to pulping and/or the delignification method can include additional treatment steps (e.g., drying the tobacco input, depithing the tobacco input, milling the tobacco input, etc.). In some embodiments, these additional steps can be conducted to remove pith from the tobacco input and/or tobacco pulp manually, and thus reduce the amount of chemicals necessary to delignify the tobacco input during a chemical pulping process, for example. Mixing water with the tobacco pulp to form a slurry and filtering the slurry can be conducted, for example, to remove some of the non-cellulosic materials, such as pith, parenchyma, and tissue from the tobacco pulp. Additional treatment steps (e.g., milling the tobacco input) can be conducted to increase the surface area of the tobacco input such that the efficacy of a pulping and/or a bleaching operation is increased. Steam- or water-based pre-hydrolysis of the tobacco stalk prior to pulping, for example, can reduce the amount of chemicals necessary in a bleaching operation. Anthraquinone can be employed in a chemical pulping method in an attempt to provide a higher yield by protecting carbohydrates from the strong base during delignification, for example. Other processing steps known in the pulping and delignification field can be employed in forming cellulosic materials from the raw tobacco input.

Black Liquor Extraction

According to the present invention, black liquor can be obtained as a byproduct of pulping biomass derived from a plant of the *Nicotiana* species and can be a source of valuable flavor compounds. Tobacco-derived black liquor can be rich in lignin depolymerization products such as 2,6-dimethyoxyphenol, guaiacol, vanillin, acetovanillone, syringaldehyde, and acetosyringone, for example. These flavor compounds can be isolated from tobacco-derived black liquor, as discussed in more detail below.

As discussed above, tobacco materials can undergo a pulping process to produce a tobacco derived fibrous material (i.e., pulp) and a residual liquid (i.e., black liquor). In various embodiments, and as illustrated at operation 104 of FIG. 1, the tobacco-derived black liquor can be separated from the cellulosic pulp through centrifugation, filtration (e.g., use of a filter cloth), or other means of liquid/solid separation. A centrifuge or other similar equipment can help with solids and liquid separations. See, e.g., the equipment disclosed in U.S. Pat. Nos. 521,104 to Davis, 3,168,474 to Stallman et al., 5,713,826 to West, and 7,060,017 to Collier, each of which is herein incorporated by reference in its entirety.

After separating the tobacco-derived black liquor from the cellulosic pulp, the black liquor is often basic as a result of chemicals used during the pulping process. As illustrated at operation 106 of FIG. 1, for example, the pH of the black liquor can be adjusted below 7. At pH greater than 8.5, the alkaloids are in the free state and therefore are easily removed by organic solvent extraction (discussed in more detail below), whereas the phenols are apparently complexed or in the form of salts at the high pH. On the contrary, at pH of 7 or lower, the alkaloids are present in the salt form and the phenolics are not such that the organic extracts are dominated by the phenolic compounds with an absence of alkaloids. As such, adjusting the pH of the black liquor below 7 can help avoid concentration of nicotine in the black liquor by generating a nicotine salt that can then be separated from the acidified black liquor. For example, the pH of the black liquor can be adjusted to a pH in the range of about 2 to 7, about 3 to 6, or about 3 to 4. In some embodiments, sulfuric acid, hydrochloric acid, or combinations thereof can be used to acidify the black liquor. However, any acid known in the art can be used to acidify the black liquor.

In various embodiments, as illustrated at operation 108 of FIG. 1, the acidified black liquor can undergo a filtration or separation process to remove any lignin salts from the acidified black liquor and thereby form a purified black liquor. For example, the acidified black liquor can be separated from any precipitate (i.e., salts) generated after adding an acid to the tobacco-derived black liquor through centrifugation, filtration (e.g., use of a filter cloth), or other means of liquid/solid separation. A centrifuge or other similar equipment can help with solids and liquid separations. See, e.g., the equipment disclosed in U.S. Pat. Nos. 521,104 to Davis, 3,168,474 to Stallman et al., 5,713,826 to West, and 7,060,017 to Collier, each of which is herein incorporated by reference in its entirety.

In certain embodiments, the acidification of the tobacco-derived black liquor can be achieved in multiple steps. As such, an acid can be added to the tobacco-derived black liquor to adjust the tobacco-derived black liquor to a first pH value. Optionally, the first acid addition can be followed by a separation step, as described above. Additional acid can be added to the tobacco-derived black liquor in a second phase to adjust the tobacco-derived black liquor to a second pH value. This process can be repeated as necessary until the desired pH is reached. In various embodiments, multiple separations can be performed during acidification of the tobacco-derived black liquor.

Following removal of any salts from the acidified black liquor, the pH of the purified black liquor can be neutralized, as illustrated at operation 110 of FIG. 1, for example. In various embodiments, the pH of the purified black liquor can be adjusted to a pH range of about 6 to 8, or about 6.5 to 7.5. The pH of the purified black liquor can be neutralized using any pH adjuster and/or buffer known in the art.

In various embodiments of the present invention, the purified black liquor can undergo an organic extraction process, as illustrated at operation 114 in FIG. 1, for example. In certain embodiments, the solvent used in the organic extraction can be polar aprotic. In various embodiments, the solvent can have a polarity of about 2.0 or greater, about 2.3 or greater, or about 2.5 or greater. In a preferred embodiment, the solvent is not miscible with water. For example, the solvent used in the organic extraction of the acidified black liquor can comprise ethers, ethyl acetate, hexanes, and combinations thereof. In a preferred embodiment, the purified black liquor can be subjected to sequential liquid-liquid extractions with a solvent comprising methyl-t-butyl-ether (MTBE), ethyl acetate (EtOAc), or combinations thereof. The one or more liquid-liquid extractions of the purified black liquor can be used to isolate organic compounds in the organic layer of the extracted black liquor.

Attempts to extract black liquor with organic solvents can result in emulsions which are extremely difficult to separate. Once separated, the organic layers can contain a large amount of water that requires drying prior to concentration. As such, in certain embodiments, the purified black liquor can be subjected to a pre-filtration step before organic solvent extraction. The purified black liquor can be pre-filtered using filters known in the art, as illustrated at operation 112 of FIG. 1, for example. For example, the purified black liquor can be subjected to nano filtration and/or filtration to isolate organic molecules of a certain size (e.g., filtered using 1 KDa and 2 KDa Sartorius® filters).

As illustrated at operation 116 in FIG. 1, for example, following the organic extraction of the purified black liquor, the organic layer can be isolated (i.e., separated from an aqueous layer) with a separatory funnel, or any means of liquid/liquid separation known in the art. The separated aqueous layer of the extracted black liquor can optionally undergo at least one additional liquid-liquid extraction. As illustrated at operation 120 in FIG. 1, for example, the isolated organic layer can subsequently undergo a drying process to form a concentrated organic layer. For example, the isolated organic layer can be dried with rotary evaporation, turbo evaporation, and/or any drying means known in the art until all the solvent is removed. The concentrated organic black liquor extract can be incorporated into various tobacco products, for example. In some embodiments, the concentrated organic extracts can be used as tobacco-derived flavorants in the form of a blending agent for a flavorant and/or as a top dressing for a tobacco product, for example.

As illustrated at operation 118 in FIG. 1, for example, a drying agent can optionally be added to the separated organic layer to help remove any excess water. In various embodiments, the drying agent can include carbon, calcium chloride ($CaCl_2$), sodium sulfate ($Na_2SO_4$) calcium sulfate ($CaSO_4$, also known as Drierite), magnesium sulfate ($MgSO_4$), and combinations thereof. In various embodiments, the drying agent can be added to the separated black liquor organic layer either before and/or after the organic layer is concentrated (e.g., undergoes a rotary evaporation process or other means for removing water known in the art).

In some embodiments, as illustrated at operation 122 of FIG. 1, for example, the concentrated organic extracts can undergo further purification. For example, the extracts can undergo chromatography separation, distillation, or any other means known in the art to isolate separate compounds within the concentrated organic extract. In various embodiments of the present invention, the concentrated organic extracts can comprise at least one of acetic acid, 3,5-dimethylcyclopentenolone, corylone, nicotine, guaiacol, 4-vinyl-2-methylphenol, vanillin, 2,6-dimethoxyphenol, acetovanillone, syringaldehyde, and acetosyringone. As discussed in more detail below, the isolated compounds can be incorporated into various tobacco products, for example.

Chromatography is a physical method of separation that distributes components to separate between two phases, a stationary phase and a mobile phase. In various embodiments of the present invention, column chromatography using a silica gel bead can be used to isolate compounds within the concentrated organic extract. The concentrated extracts can be loaded on top of a silica gel column and eluted with mixtures of hexane and ethyl acetate, for example. In certain embodiments, an initial solvent mixture (e.g., about 75% hexane and about 25% ethyl acetate by volume) can be used to slurry up the silica gel for pouring into the column. Once the column is loaded, solvent can be fed to the column which has been pressurized to a steady state. The column eluent can then be collected. The eluent fractions contain different compounds of interest, as described above. The fractions can be concentrated to remove the solvent (e.g., hexane and/or ethyl acetate).

Uses of Tobacco-Derived Black Liquor in Tobacco Products

Organic compounds derived from black liquor generated according to the present invention can be useful as components (e.g., flavorants) incorporated into tobacco products, for example. The tobacco product to which the materials of the invention are added can vary, and can include any product configured or adapted to deliver tobacco or some component thereof to the user of the product. Exemplary tobacco products include smoking articles (e.g., cigarettes), smokeless tobacco products, and aerosol-generating devices that contain a tobacco material or other plant material that is not combusted during use.

Figure 2:
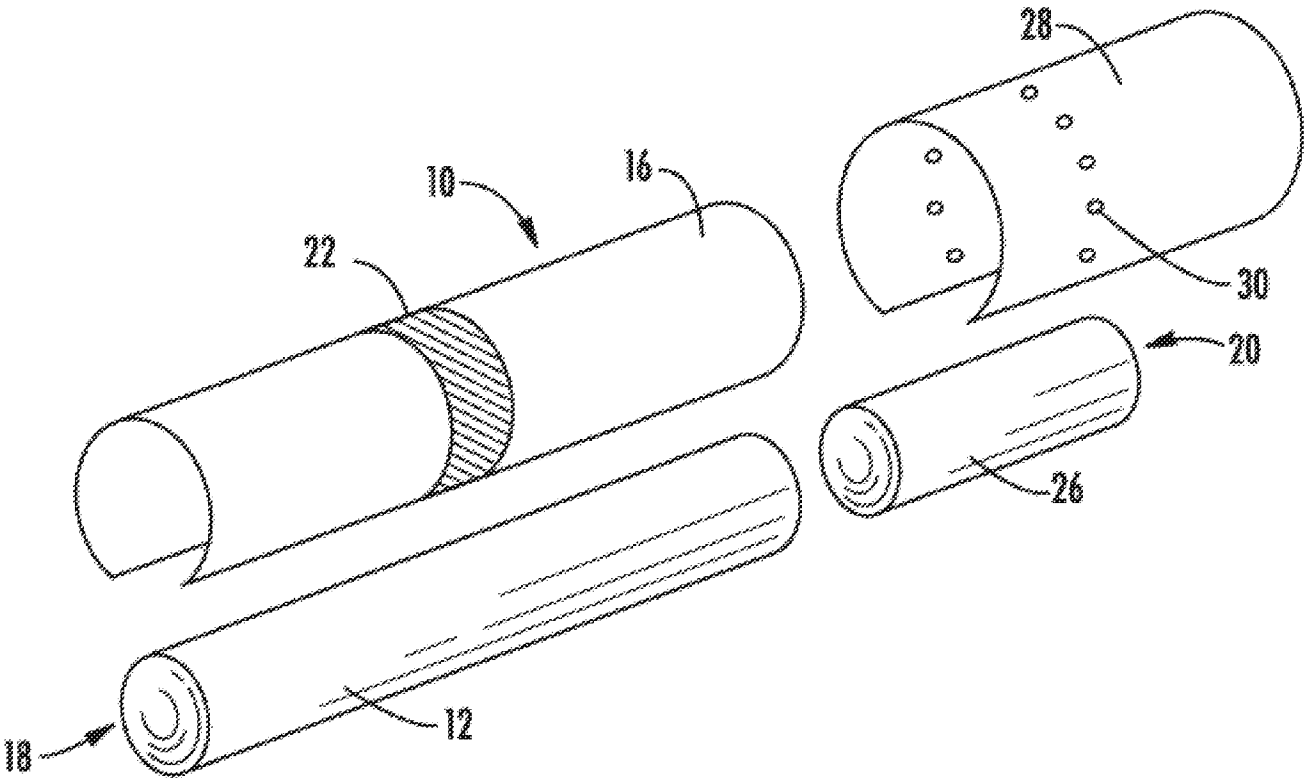
FIG. 2 is an exploded perspective view of a smoking article having the form of a cigarette, showing the smokable material, the wrapping material components, and the filter element of the cigarette.

In various embodiments of the present invention, tobacco-derived organic extracts can be incorporated into smoking articles in the form of a flavorant or a component of a flavorant in a tobacco composition and/or in a filter element of a smoking article. For example, tobacco-derived organic extracts can be incorporated into a top dressing or casing of a tobacco product. Referring to FIG. 2, there is shown a smoking article 10 in the form of a cigarette and possessing certain representative components of a smoking article that can contain products derived from the cellulosic sugar materials of the present invention. The cigarette 10 includes a generally cylindrical rod 12 of a charge or roll of smokable filler material (e.g., about 0.3 to about 1.0 g of smokable filler material such as tobacco material) contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. The band 22 can be printed on the inner surface of the wrapping material (i.e., facing the smokable filler material), or less preferably, on the outer surface of the wrapping material.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough. A plug wrap 28 enwraps the filter element and a tipping material (not shown) enwraps the plug wrap and a portion of the outer wrapping material 16 of the rod 12, thereby securing the rod to the filter element 26.

The filter element of the invention typically comprises multiple longitudinally extending segments. Each segment can have varying properties and may include various materials capable of filtration or adsorption of particulate matter and/or vapor phase compounds. Typically, the filter element of the invention includes 2 to 6 segments, frequently 2 to 4 segments. In one preferred embodiment, the filter element includes a mouth end segment, a tobacco end segment and a compartment therebetween. This filter arrangement is sometimes referred to as a "compartment filter" or a "plug/space/plug" filter. The compartment may be divided into two or more compartments as described in greater detail below.

In various embodiments, the filter element can comprise an adsorbent in the form of an activated carbon material, wherein the activated carbon is capable of removing at least one gas phase component of mainstream smoke is incorporated into the filter element. In certain embodiments, the filter element 26 can include ventilation holes 30 that extend through the tipping paper (not shown) and the plug wrap 28 and, thus, provide air dilution of mainstream smoke. The ventilation holes 30 may be configured as a single line of perforations extending circumferentially around the filter element 26 or may comprise several lines of perforations. As would be understood, the exact count and size of the ventilation holes 30 will vary depending on the desired level of air dilution.

Figure 3:
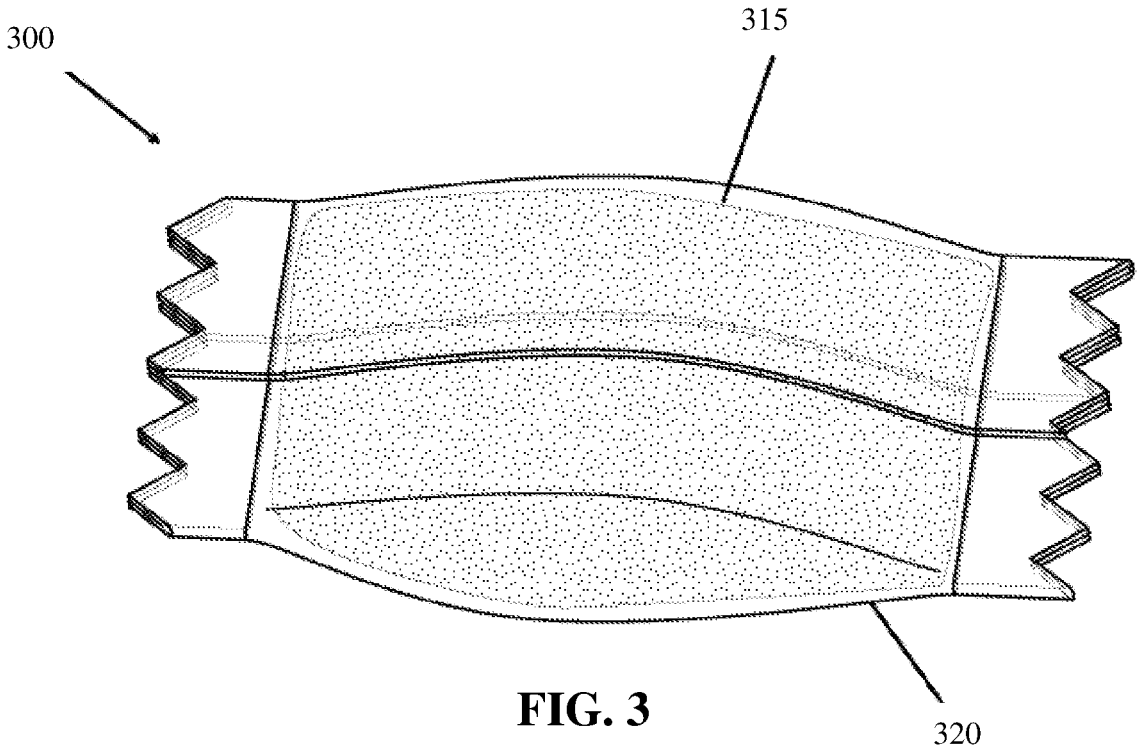
FIG. 3 is a top view of a smokeless tobacco product embodiment, taken across the width of the product, showing an outer pouch filled with a tobacco material.

In various embodiments of the present invention, at least one tobacco-derived flavor compound and/or organic extract isolated from tobacco-derived black liquor can be incorporated into smokeless tobacco products in the form of a flavorant or a component of a flavorant in a smokeless tobacco formulation. The form of the smokeless tobacco product of the invention can vary. In one particular embodiment, the product is in the form of a snus-type product containing a particulate tobacco material and a flavorant comprising at least one compound isolated from tobacco-derived black liquor. Manners and methods for formulating snus-type tobacco formulations will be apparent to those skilled in the art of snus tobacco product production. For example, as illustrated in FIG. 3, an exemplary pouched product 300 can comprise an outer water-permeable container 320 in the form of a pouch which contains a particulate mixture 315 adapted for oral use. The orientation, size, and type of outer water-permeable pouch and the type and nature of the composition adapted for oral use that are illustrated herein are not construed as limiting thereof.

In various embodiments, a moisture-permeable packet or pouch can act as a container for use of the composition within. The composition/construction of such packets or pouches, such as the container pouch 320 in the embodiment illustrated in FIG. 3, may be varied as noted herein. For example, suitable packets, pouches or containers of the type used for the manufacture of smokeless tobacco products, which can be modified according to the present invention, are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. A pouch type of product similar in shape and form to various embodiments of a pouched product described herein is commercially available as ZONNIC (distributed by Niconovum AB). Additionally, pouch type products generally similar in shape and form to various embodiments of a pouched product are set forth as snuff bag compositions E-J in Example 1 of PCT WO 2007/104573 to Axelsson et al., which is incorporated herein by reference, which are produced using excipient ingredients and processing conditions that can be used to manufacture pouched products as described herein.

The amount of material contained within each pouch may vary. In smaller embodiments, the dry weight of the material within each pouch is at least about 50 mg to about 150 mg. For a larger embodiment, the dry weight of the material within each pouch preferably does not exceed about 300 mg to about 500 mg.

In some embodiments, each pouch/container can have disposed therein a flavor agent member, as described in greater detail in U.S. Pat. No. 7,861,728 to Holton, Jr. et al., which is incorporated herein by reference. The flavor agent member can comprise a flavorant comprising at least one organic compound and/or concentrated organic extract isolated from black liquor derived from tobacco materials, as discussed above. If desired, other components can be contained within each pouch. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. Nos. 6,887,307 to Scott et al. and 6,923,981 to Leung et al.; and The EFSA Journal (2004) 85, 1-32; which are incorporated herein by reference.

In various embodiments, the outer water-permeable pouch can comprise PLA or other pouch materials known in the art. Descriptions of various components of snus types of products and components thereof also are set forth in US Pat. App. Pub. No. 2004/0118422 to Lundin et al., which is incorporated herein by reference. See, also, for example, U.S. Pat. Nos. 4,607,479 to Linden; 4,631,899 to Nielsen; 5,346,734 to Wydick et al.; and 6,162,516 to Derr, and US Pat. Pub. No. 2005/0061339 to Hansson et al.; each of which is incorporated herein by reference. See, also, the types of pouches set forth in U.S. Pat. No. 5,167,244 to Kjerstad, which is incorporated herein by reference. Snus types of products can be manufactured using equipment such as that available as SB 51-1/T, SBL 50 and SB 53-2/T from Merz Verpackungmaschinen GmBH. Snus pouches can be provided as individual pouches, or a plurality of pouches (e.g., 2, 4, 5, 10, 12, 15, 20, 25 or 30 pouches) can connected or linked together (e.g., in an end-to-end manner) such that a single pouch or individual portion can be readily removed for use from a one-piece strand or matrix of pouches.

The invention is not limited to snus-type smokeless tobacco products. For example, the mixture of tobacco material and flavorants comprising at least one isolated flavor compound and/or tobacco-derived organic extract can also be incorporated into various smokeless tobacco forms such as loose moist snuff, loose dry snuff, chewing tobacco, pelletized tobacco pieces, extruded tobacco strips or pieces, finely divided or milled agglomerates of powdered pieces and components, flake-like pieces (e.g., that can be formed by agglomerating tobacco formulation components in a fluidized bed), molded tobacco pieces (e.g., formed in the general shape of a coin, cylinder, bean, cube, or the like), pieces of tobacco-containing gum, products incorporating mixtures of edible material combined with tobacco pieces and/or tobacco extract, products incorporating tobacco (e.g., in the form of tobacco extract) carried by a solid inedible substrate, and the like. For example, the smokeless tobacco product can have the form of compressed tobacco pellets, multi-layered extruded pieces, extruded or formed rods or sticks, compositions having one type of tobacco formulation surrounded by a different type of tobacco formulation, rolls of tape-like films, readily water-dissolvable or water-dispersible films or strips (see, for example, US Pat. Appl. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtoniam fluid or a thixotropic fluid incorporating tobacco of some form).

In some embodiments, smokeless tobacco products of the invention can have the form of a lozenge, tablet, microtab, or other tablet-type product. See, for example, the types of lozenge formulations and techniques for formulating or manufacturing lozenges set forth in U.S. Pat. Nos. 4,967,773 to Shaw; 5,110,605 to Acharya; 5,733,574 to Dam; 6,280,761 to Santus; 6,676,959 to Andersson et al.; 6,248,760 to Wilhelmsen; and 7,374,779; US Pat. Pub. Nos. 2001/0016593 to Wilhelmsen; 2004/0101543 to Liu et al.; 2006/0120974 to Mcneight; 2008/0020050 to Chau et al.; 2009/0081291 to Gin et al.; and 2010/0004294 to Axelsson et al.; which are incorporated herein by reference.

Depending on the type of smokeless tobacco product being processed, the tobacco product can include one or more additional components in addition to the tobacco material and the flavorants comprising at least one flavor compound and/or organic extract isolated from tobacco-derived black liquor. For example, the tobacco material and the tobacco-derived flavorants can be processed, blended, formulated, combined and/or mixed with other materials or ingredients, such as other tobacco materials or flavorants, fillers, binders, pH adjusters, buffering agents, salts, sweeteners, colorants, disintegration aids, humectants, and preservatives (any of which may be an encapsulated ingredient). See, for example, those representative components, combination of components, relative amounts of those components and ingredients relative to tobacco, and manners and methods for employing those components, set forth in US Pat. Pub. Nos. 2011/0315154 to Mua et al. and 2007/0062549 to Holton, Jr. et al. and U.S. Pat. No. 7,861,728 to Holton, Jr. et al., each of which is incorporated herein by reference.

In various embodiments, at least one flavor compound and/or organic extract isolated from tobacco-derived black liquor can be incorporated into smokeless tobacco products in the form of a flavorant (or a component thereof) in an electronic smoking article. There have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. Pat. Pub. Nos. 2013/0255702 to Griffith Jr. et al., 2014/0000638 to Sebastian et al., 2014/0060554 to Collett et al., 2014/0096781 to Sears et al., 2014/0096782 to Ampolini et al., and 2015/0059780 to Davis et al., which are incorporated herein by reference in their entirety.

Figure 4:
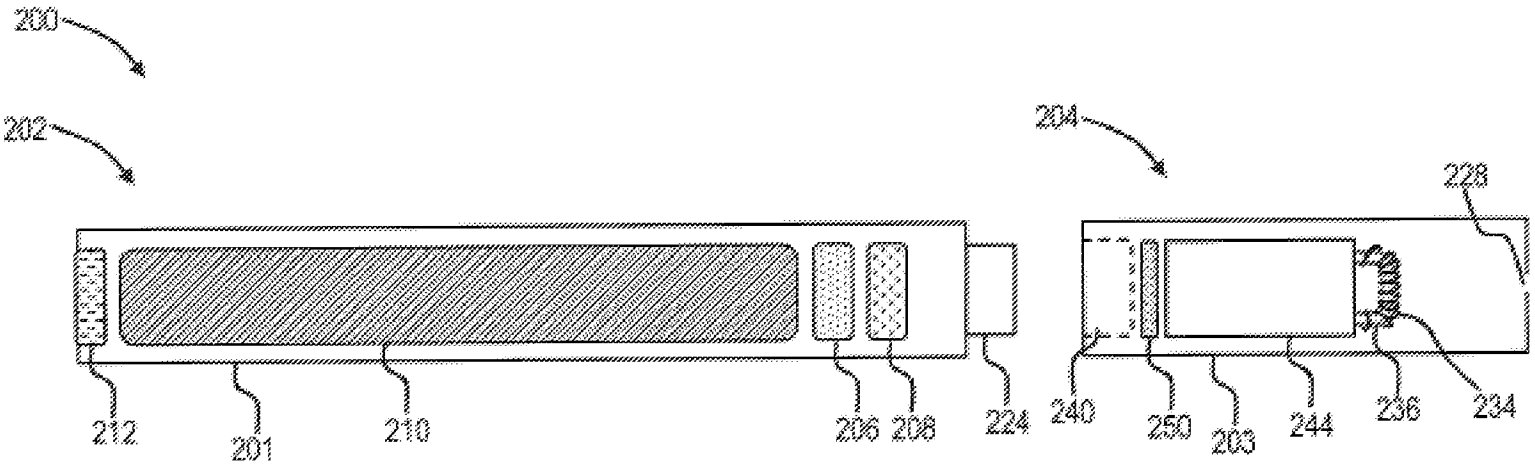
FIG. 4 is a sectional view through an electronic smoking article comprising a cartridge and a control body and including a reservoir housing according to an example embodiment of the present disclosure.

An exemplary embodiment of an electronic smoking article 200 is shown in FIG. 4. As illustrated therein, a control body 202 can be formed of a control body shell 201 that can include a control component 206, a flow sensor 208, a battery 210, and an LED 212. A cartridge 204 can be formed of a cartridge shell 203 enclosing a reservoir housing 244 that is in fluid communication with a liquid transport element 236 adapted to wick or otherwise transport an aerosol precursor composition stored in the reservoir housing to a heater 234. An opening 228 may be present in the cartridge shell 203 to allow for egress of formed aerosol from the cartridge 204. Such components are representative of the components that may be present in a cartridge and are not intended to limit the scope of cartridge components that are encompassed by the present disclosure. The cartridge 204 may be adapted to engage the control body 202 through a press-fit engagement between the control body projection 224 and the cartridge receptacle 240. Such engagement can facilitate a stable connection between the control body 202 and the cartridge 204 as well as establish an electrical connection between the battery 210 and control component 206 in the control body and the heater 234 in the cartridge.

The cartridge 204 also may include one or more electronic components 250, which may include an IC, a memory component, a sensor, or the like. The electronic component 250 may be adapted to communicate with the control component 206. The various components of an electronic smoking device according to the present disclosure can be chosen from components described in the art and commercially available.

In various embodiments, the aerosol precursor composition can comprise a flavorant comprising at least one tobacco-derived flavor compound and/or organic extract isolated from tobacco-derived black liquor. Exemplary formulations for aerosol precursor materials that may be used according to the present disclosure are described in U.S. Pat. No. 7,217,320 to Robinson et al.; U.S. Pat. Pub. Nos. 2013/0008457 to Zheng et al.; 2013/0213417 to Chong et al.; 2014/0060554 to Collett et al.; and 2014/0000638 to Sebastian et al., the disclosures of which are incorporated herein by reference in their entirety. Other aerosol precursors that can incorporate at least one tobacco-derived flavor compound and/or organic extract isolated from tobacco-derived black liquor described herein include the aerosol precursors that have been incorporated in the VUSE® product by R. J. Reynolds Vapor Company, the BLU™ product by Imperial Tobacco, the MISTIC MENTHOL product by Mistic Ecigs, and the VYPE product by CN Creative Ltd. Also desirable are the so-called "smoke juices" for electronic cigarettes that have been available from Johnson Creek Enterprises LLC.

EXPERIMENTAL

Aspects of the present invention are more fully illustrated by the following examples, which are set forth to illustrate certain aspects of the present invention and are not to be construed as limiting thereof.

Example 1

Flavorful compounds are isolated from tobacco stalk black liquor obtained during the pulping of burley tobacco stalk.

Burley tobacco stalk is subjected to pulping and bleaching processes resulting in a white, high α-cellulose pulp and residual black liquor. The caustic (i.e., soda) pulping process involves exposing de-pithed and decorticated stalk material to a 40% NaOH solution (soda liquor) at a ratio of 5:1 liquor to solid on a weight basis. The stalks and liquor are then subjected to 160 psi of pressure at a temperature of 100° C. for 2 hours. The resulting black liquor is separated from the solid material using filter mesh (~20 μm). The black liquor has a pH of 13.

Two liters of tobacco stalk black liquor is transferred to a 4 L beaker. The pH is reduced from 13 to 4 by adding 5N HCl to the beaker, which results in a thick brown precipitate. The mixture of liquor and precipitate is added exhaustively to 50 mL conical centrifuge tubes and centrifuged at 2500 rpm for 10 minutes. The liquor is decanted from the precipitate pellet, which yields a more translucent brown liquid.

The clarified liquor is adjusted to pH 7.5 and subjected to liquid-liquid extraction with methyl-t-butyl-ether (MTBE). About 400 mL of clarified black liquor is added to four 1 L separatory funnels (2 L starting volume, plus HCl volume, minus the precipitate contribution to volume results in approximately 1600 mL final volume). 150 mL of MTBE is added to each separatory funnel and then shaken three times at one minute intervals. After the third agitation, the contents of the funnel are allowed to partition for five minutes after which the funnel is drained and each layer, aqueous and organic, is captured in separate containers. A second liquid-liquid extraction of the aqueous layer is performed using the above conditions.

The MTBE fractions from both extractions are mixed and turbo evaporated at 40° C. and nitrogen pressure at 10 psi. The resulting residue, 2 mL, is mixed with 200 proof ethanol to a final volume of 3 mL and subjected to GC-MS analysis. The remaining aqueous portion from the liquid-liquid extraction is allowed to stand in the fume hood overnight to remove any remaining MTBE and then stored for future evaluation.

Major peaks in the GC-MS chromatogram include nicotine, vanillin, 2,6-dimethoxyphenol, acetovanillone, syringaldehyde, acetosyringone, phenol, and guaiacol. The extract has a unique aroma, smoky vanilla, combined with the presence of nicotine. Other, smaller peaks include corylone, phenethyl alcohol, ethyl guaiacol, myosmine, nicotyrine, furancarboxaldehyde, and bipyridine.

Example 2

Flavorful compounds are isolated from tobacco stalk black liquor obtained during the pulping of burley tobacco stalk. Clarified black liquor is obtained according to the process described in Example 1 above.

The clarified liquor is adjusted to pH 7.5 and subjected to liquid-liquid extraction with MTBE and ethyl acetate (EtOAc). About 500 mL of clarified black liquor is added to four 1 L separatory funnels (2.5 L starting volume, plus HCl volume, minus the precipitate contribution to volume results in approximately 2000 mL final volume). 250 mL of MTBE is added to each separatory funnel and then shaken three times at one minute intervals. After the third agitation, the contents of the funnel are allowed to partition for five minutes after which the funnel is drained and each layer, aqueous and organic, is captured in separate containers. A second liquid-liquid extraction of the aqueous layer is performed using MTBE and the above conditions. A third liquid-liquid extraction is performed. 250 mL of ethyl acetate is added to the aqueous layer of each refilled funnel. Each funnel is agitated as prescribed and the partitioned layers are captured in separate vessels.

The MTBE fractions from the first two extractions are mixed and turbo evaporated at 40° C. and nitrogen pressure at 10 psi. The ethyl acetate fractions are combined and evaporated separately from the MTBE extracts using a similar evaporation protocol which differs only in the evaporation step (the ethyl acetate is rotary evaporated using a vacuum of 300 mmHg instead). The final, evaporated volume for the MTBE and ethyl acetate fractions is 3 mL and 1 mL, respectively. The MTBE evaporate has a smoky vanilla aroma while the ethyl acetate evaporate has a sweet, vanilla smell. Both fractions are subjected to GC-MS analysis.

The chromatograms of the GC-MS analyses are produced from the injection of a 1:150 dilution of the final concentrated extract so as to perform semi-quantitative analysis of nicotine and several flavors. Major peaks in the GC-MS chromatogram for the MTBE extract dilution include nicotine, vanillin, 2,6-dimethoxyphenol, acetovanillone, syringaldehyde, acetosyringone, phenol, and guaiacol. The extract has a unique aroma, smoky vanilla, combined with the presence of nicotine. Major peaks in the GC-MS chromatogram for the ethyl acetate extract dilution include nicotine, vanillin, 2,6-dimethoxyphenol, acetovanillone, syringaldehyde, and acetosyringone. The extract has a unique aroma, smoky vanilla, combined with the presence of nicotine. Phenol and guaiacol, generally characterized as having smoky aroma and flavor character, are relatively lower in the ethyl acetate extract chromatogram.

Semi-quantitative analysis is performed on the MTBE and ethyl acetate extracts for the following analytes: 2,6-dimethoxyphenol, vanillin, acetovanillone, and nicotine. For the MTBE extract, there is 69 mg of 2,6-dimethoxyphenol (23 mg/mL), 60 mg of vanillin (20 mg/mL), 60 mg of acetovanillone (20 mg/mL), and 393 mg of nicotine (131 mg/mL) extractable from the 3 mL of MTBE extract. For the ethyl acetate extract, there is 3 mg of 2,6-dimethoxyphenol (3 mg/mL), 28 mg of vanillin (28 mg/mL), 14 mg of acetovanillone (14 mg/mL), and 46 mg of nicotine (46 mg/mL) extractable from the 1 mL of MTBE extract. As such, there is a total of 72 mg of 2,6-dimethoxyphenol, 88 mg of vanillin, 74 mg of acetovanillone, and 439 mg of nicotine extractable from the extract obtained from 2.5 L of black liquor (starting volume). It is estimated that about 40 grams of vanillin can be extracted from 1000 L of black liquor using this extraction protocol.

Example 3

Flavorful compounds are isolated from tobacco stalk black liquor obtained during the pulping of burley tobacco stalk.

Burley tobacco stalk is subjected to pulping and bleaching processes resulting in a white, high α-cellulose pulp and residual black liquor. The caustic (i.e., soda) pulping process involves exposing de-pithed and decorticated stalk material to a 40% NaOH solution (soda liquor) at a ratio of 5:1 liquor to solid on a weight basis. The stalks and liquor are then subjected to 160 psi of pressure at a temperature of 100° C. for 2 hours. The resulting black liquor is separated from the solid material using filter mesh (~20 μm). The black liquor has a pH of 13.

Two liters of tobacco stalk black liquor is transferred to a 4 L beaker. The pH is reduced from 13 to 4 by adding 5N $H_2SO_4$ to the beaker, which results in a thick brown precipitate. The mixture of liquor and precipitate is added exhaustively to 750 mL conical centrifuge tubes and centrifuged at 2500 rpm for 10 minutes. The liquor is decanted from the precipitate pellet, which yields a more translucent brown liquid.

Half of the final volume, 900 mL, is lowered from pH 4 to 3 with the addition of more $H_2SO_4$ (BL-acidic). The remaining half of the final volume is adjusted to pH 7.5 with NaOH (BL-basic). Half of the volume of BL-acidic is added to each of two different separatory funnels and half of the volume of BL-basic is added to each of two different separatory funnels. To one BL-acidic and BL-basic funnel is added 250 mL of MTBE. For the remaining BL-acidic and BL-basic funnels, 250 mL of ethyl acetate is added to each. All four flasks are shaken for 10 seconds, allowed to rest for 2 minutes, and shaken again for 10 seconds. After the two phases settle out, they are collected in one liter glass containers (8 total: 4 solvent phase and 4 aqueous phase). Each aqueous phase is returned to its respective funnel and the same liquid-liquid extraction is performed for each funnel a second time with the same solvent type as the first extraction. The solvent from each extraction for the same separatory funnel is combined and dried using rotary evaporation. This results in approximately 500 mL of solvent volume in each container. Aliquots from each of the eight containers are transferred to GC vials for analysis.

Major peaks in the GC-MS chromatogram for the pooled ethyl acetate extract of the acidic black liquor include acetic acid, 3,5-dimethylcyclopentenolone, corylone, nicotine, guaiacol, 4-vinyl-2-methylphenol, vanillin, 2,6-dimethoxyphenol, acetovanillone, syringaldehyde, and acetosyringone. In this chromatogram, virtually no nicotine is present and a fairly pure guaiacol peak is observed (nicotine and guaiacol co-elute at 14.8 minutes). The same major peaks are identified of the corresponding aqueous layer of the pooled ethyl acetate extract of the acidic black liquor, however, nicotine is the foremost peak in the aqueous phase. The nicotine likely exists as a salt and is therefore not extractable into the organic phase.

Major peaks in the GC-MS chromatogram for the pooled ethyl acetate extract of the basic black liquor include acetic acid, 3,5-dimethylcyclopentenolone, corylone, nicotine, guaiacol, 4-vinyl-2-methylphenol, vanillin, 2,6-dimethoxyphenol, acetovanillone, syringaldehyde, and acetosyringone. Nicotine exists as a free base at this pH and is therefore easily extracted from the aqueous layer with the organic solvent and is by far the largest peak in the chromatogram (very little guaiacol contribution to the peak at the given retention time). The same major peaks are identified of the corresponding aqueous layer of the pooled ethyl acetate extract of the basic black liquor, however, there is no noticeable nicotine in the aqueous portion.

Major peaks in the GC-MS chromatogram for the pooled MTBE extract of the acidic black liquor include acetic acid, 3,5-dimethylcyclopentenolone, corylone, nicotine, guaiacol, 4-vinyl-2-methylphenol, vanillin, 2,6-dimethoxyphenol, acetovanillone, syringaldehyde, and acetosyringone. Once again, very little to no nicotine was extracted in the organic phase due to the low pH of the aqueous phase. The same major peaks are identified of the corresponding aqueous layer of the pooled MTBE extract of the acidic black liquor, however, nicotine is the foremost peak in the aqueous phase because nicotine remained in the salt form due to the low pH of the aqueous phase.

Major peaks in the GC-MS chromatogram for the pooled MTBE extract of the basic black liquor include acetic acid, 3,5-dimethylcyclopentenolone, corylone, nicotine, guaiacol, 4-vinyl-2-methylphenol, vanillin, 2,6-dimethoxyphenol, acetovanillone, syringaldehyde, and acetosyringone. Nicotine exists as a free base at this pH and is therefore easily extracted from the aqueous layer with the organic solvent and is by far the largest peak in the chromatogram (very little guaiacol contribution to the peak at the given retention time). The same major peaks are identified of the corresponding aqueous layer of the pooled MTBE extract of the basic black liquor, however, there is no noticeable nicotine in the aqueous portion.

Semi-quantitative analysis is performed on each of the 8 total extracts for the following analytes: acetic acid, 3,5-dimethylcyclopentenolone, corylone, nicotine, guaiacol, 4-vinyl-2-methylphenol, vanillin, 2,6-dimethoxyphenol, acetovanillone, syringaldehyde, and acetosyringone. 2,6-dimethoxyphenol, 3,5-dimethylcyclopentenolone, corylone and vanillin are not fully extracted at basic pH, as evidenced by their presence in the aqueous portion post-solvent extraction. Nearly complete extraction of flavor compounds is achieved by multistep liquid-liquid extraction with the same solvent at acidic pH. Acetic acid is extractable from an aqueous layer with solvent, but is more amenable to solvent partitioning with an acidic pH of the aqueous layer. Using MTBE and ethyl acetate results in similar chemical profiles in the final extracts, however, MTBE is more easily evaporated.

Example 4

Flavorful compounds are isolated from tobacco stalk black liquor obtained during the standard Kraft pulping process (NaOH, NaS) of tobacco stalks.

A 100 mL aliquot of the black liquor (pH about 14) is extracted two times with equi-volume portions of MTBE. The MTBE layer is separated, dried over $Na_2SO_4$, filtered and concentrated on a rotary evaporator.

A second 100 mL aliquot of the black liquor is neutralized using 2N HCL to an approximate pH of 7, resulting in an enormous amount of precipitate. The entire mixture is extracted two times with equi-volume portions of MTBE. The MTBE layer is separated, dried over $Na_2SO_4$, filtered and concentrated on a rotary evaporator.

The two extract samples are analyzed using GC-MS on a DB-Wax, 30 m×0.25 mm with a 0.25μ film thickness using a temperature program from 60° C. to 220° C. at 5° C./min. The chromatogram of the MTBE extract of the black liquor with no pH adjustment shows that nicotine is the major component. The other identified compounds include modest amounts of myosmine, nicotyrine, and bipyridine, all alkaloid degradation products and very small amounts of phenethyl alcohol, 2-acetylpyrrole, and 4-ethylguaiacol. The chromatogram of the MTBE extract of the black liquor after pH adjustment to approximately 7 with 2N HCl shows components typical to those identified in Examples 1-3 above, including substituted phenols and vanillic compounds.

Example 5

Flavorful compounds are isolated from tobacco stalk black liquor obtained during the pulping of burley tobacco stalk.

Burley tobacco stalk is subjected to pulping and bleaching processes resulting in a white, high α-cellulose pulp and residual black liquor. The caustic (i.e., soda) pulping process involves exposing de-pithed and decorticated stalk material to a 40% NaOH solution (soda liquor) at a ratio of 5:1 liquor to solid on a weight basis. The stalks and liquor are then subjected to 160 psi of pressure at a temperature of 100° C. for 2 hours. The resulting black liquor is separated from the solid material using filter mesh (~20 μm). The black liquor has a pH of 14 or greater.

Black liquor samples are filtered through a 0.22 micron filter and two different Cross Flow Filtration membranes to isolate organic molecules less than 2 KDa and 1 KDa molecular weight cut-off. 100 mL samples of the 1 KDa and 2 KDa retentates and permeates are each extracted with 100 mL of MTBE in a 500 mL separatory funnel. The MTBE extracts are separated, dried over sodium sulfate, and concentrated using rotary evaporator to approximately 1 mL. The concentrated extract is transferred to a GC vial using MTBE and analyzed.

A second set of 100 mL samples of the retentates and permeates are placed in beakers with magnetic stirring. 2N $H_2SO_4$ is added in small aliquots until the pH reaches approximately 6. A light precipitate is formed. The pH adjusted samples are then extracted with MTBE, dried, concentrated, and analyzed.

At pH 14, the chromatogram contains predominantly nicotine and very little else. At pH 6, the chromatogram shows numerous components in four groups. Group 1 represented by acetic acid is the small chain organic acids. Group 2 is sugar degradation products such as 3,5-dimethylcyclopentenolone and corylone. Group 3 is phenols including guaiacol (methoxyphenols) and dimethoxyphenol. Group 4 contains vanillin, acetovanillone, syringaldehyde, and acetosyringone. Both extracts are distinct and display no overlap. Specifically, there is no nicotine in the pH 6 extract and there is only nicotine in the pH 14 extract. In the pH 6 extract, nicotine has formed a salt with sulfate from the sulfuric acid and is preferentially soluble in water which accounts for its absence in the pH 6 extract. Likewise, in the pH 14 extract, nicotine is in its non-salt form and can be extracted into MTBE. The phenols in pH 14 environments are ionized and insoluble in organic solvents explaining their absence in the pH 14 extract. If performed consecutively, this set of extractions, pH 14 followed by pH 6, allows for a nicotine-free extract of black liquor that contains a flavorful mixture of phenols including smoky types (guaiacol) and sweet types (vanillin).

The total amount of both the 1 KDa and 2 KDa permeates (590 mL) is combined into one sample and extracted with a like volume of MTBE twice. The MTBE is discarded. The water layer is then neutralized to slightly acidic pH with 140 mL of 2N $H_2SO_4$, extracted twice with 750 mL of MTBE, dried using $Na_2SO_4$, and concentrated to dryness on the rotary evaporator, yielding 1.345 g of solvent free extract.

Filtration of the black liquor using small micron filters (0.22 micron) and subsequent filtration through 1 KDa and 2 KDa filters significantly improves the downstream MTBE extraction of the black liquor. Initial shaking of the filtered aqueous black liquor with MTBE results in an emulsion that rapidly separated into two relatively clean fractions that can easily be separated. Minimal precipitates are encountered and are easily filtered away using filter paper and vacuum filtration. Drying of the organic layer is still used, but is not extraordinary in any respect. Pre-filtration to remove fine dissolved solids and size exclusion filtration provides for an easier organic extraction process of black liquor.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of isolating compounds from a tobacco-derived black liquor, comprising:

receiving a black liquor from a pulping process of an input material comprising a plant of the *Nicotiana* species;

treating the black liquor with an acid to lower the pH of the black liquor to 6 or lower in order to produce a precipitate and an acidified black liquor;

separating the precipitate and the acidified black liquor;

neutralizing the acidified black liquor by raising the pH to within a range from about 6.5 to 7.5 to form a neutralized black liquor;

extracting the neutralized black liquor with an organic solvent in order to produce an organic layer extract and an aqueous layer extract;

separating the organic layer extract and the aqueous layer extract;

concentrating the organic layer extract by evaporating the organic solvent in order to produce a concentrated organic layer extract; and separating the concentrated organic layer extract into multiple fractions, wherein each fraction comprises at least one flavor compound.

2. The method of claim 1, further comprising treating the concentrated organic layer extract with a drying agent in order to remove excess water.

3. The method of claim 1, wherein the at least one flavor compound is selected from the group consisting of acetic acid, 3,5-dimethylcyclopentenolone, corylone, guaiacol, 4-vinyl-2-methylphenol, vanillin, 2,6-dimethoxyphenol, acetovanillone, syringaldehyde, acetosyringone, and combinations thereof.

4. The method of claim 1, wherein the step of separating the concentrated organic layer extract into multiple fractions comprises chromatography separation of the concentrated organic layer extract.

5. The method of claim 1, wherein the step of separating the concentrated organic layer extract into multiple fractions comprises distillation of the concentrated organic layer extract.

6. The method of claim 1, further comprising incorporating at least one fraction into a tobacco product.

7. The method of claim 6, wherein the tobacco product is a smoking article.

8. The method of claim 6, wherein the tobacco product is a smokeless tobacco product.

9. The method of claim 1, further comprising treating the organic layer extract with a drying agent in order to remove excess organic solvent.

10. The method of claim 1, wherein the organic solvent has a polarity of about 2.0 or greater.

11. The method of claim 1, wherein the organic solvent comprises methyl-t-butyl -ether, ethyl acetate, or a combination thereof.

12. The method of claim 1, wherein the treating step comprises lowering the pH of the black liquor to about 4 or less.

13. The method of claim 1, wherein the acid used in the treating step is hydrochloric acid, sulfuric acid, or a combination thereof.

14. The method of claim 1, further comprising:

receiving a tobacco material comprising at least one of a stalk material and a root material of a harvested plant of the Nicotiana species;

chemically pulping the tobacco material to form a tobacco-derived pulp and the black liquor; and separating the tobacco-derived pulp and the black liquor.

15. The method of claim 14, wherein the tobacco material comprises at least about 90 percent by dry weight of at least one of the stalk material and the root material of the harvested plant of the Nicotiana species.

* * * * *